United States Patent [19]

Baird et al.

[11] Patent Number: 4,730,645

[45] Date of Patent: Mar. 15, 1988

[54] QUICK CHANGE KIT FOR FLUID JET LOOM

[75] Inventors: Jody Baird; James A. Eastridge; Herman Timbs, all of Mountain City, Tenn.

[73] Assignee: Burlington Industries, Inc.

[21] Appl. No.: 10,694

[22] Filed: Feb. 4, 1987

[51] Int. Cl.[4] ..... D03D 47/30

[52] U.S. Cl. ..... 139/435; 139/452

[58] Field of Search ..... 139/429, 435, 450, 452

[56] References Cited

U.S. PATENT DOCUMENTS

| | | | |
|---|---|---|---|
| 3,604,472 | 9/1971 | Nydam | 139/452 |
| 3,722,551 | 3/1973 | Mizuno et al. | 139/435 |
| 3,885,599 | 5/1975 | Mawdsley et al. | 139/435 |
| 4,372,349 | 2/1983 | Mullekom | 139/452 |
| 4,586,543 | 5/1986 | Volland et al. | 139/452 |

*Primary Examiner*—Henry S. Jaudon

*Attorney, Agent, or Firm*—Cushman, Darby & Cushman

[57] ABSTRACT

A "pick and pick" unit for weaving fabric on a fluid jet weaving machine is modified by a quick change kit to function as a single pick unit. A method of modifying the "pick and pick" unit is also disclosed.

14 Claims, 3 Drawing Figures

QUICK CHANGE KIT FOR FLUID JET LOOM

BACKGROUND OF THE INVENTION

1. Field of the Invention

The present invention relates generally to the weaving of textiles and, in particular, to a quick change kit for a fluid jet weaving loom.

2. Description of the Related Art

In the current state of the art of weaving textiles, there are two types of jet looms: air and water. In water jet weaving looms, there are two types of picking apparatuses: single pick and so-called "pick and pick". "Picking" may be defined as the operation of passing a "pick", i.e. a filling yarn, through a warp shed during the weaving process on the loom. The "pick" may be more specifically defined as a single filling thread shot by the water jet through the warp shed which extends across the loom. The picks or filling yarns are interlaced with the warp ends to form a woven fabric. See "Man-Made Fiber and Textile Dictionary" (3rd Ed. 1974) at pp. 81–82.

The single pick unit is used for particularly simple woven fabric styles. The pick and pick unit is used for more complex woven fabric styles using either one or two different types of filling yarns. Whenever a weaver has wanted to change a loom from producing a style of fabric with a single pick unit to producing a different, more fanciful style of fabric with a pick and pick unit (or vice versa), about 18 man-hours of work have been required to make the conversion because, either way, the entire pick insertion unit must be removed from the loom and replaced with the other unit. This amount of down time is deemed severe.

In FIG. 1 of the drawings, the single pick unit 10 of the prior art is illustrated. More particularly, the unit 10 is a Nissan water jet loom, as are all the other looms illustrated herein. The yarn 12 is drawn from a supply package 14 directly to a feed roll 16. The amount of yarn 12 that is wrapped around the feed roll 16 is determined by a measuring drum 18. The measuring drum 18 drives the feed roll 16 by contacting a shaft 26 which rotates the feed roll 16. In order to change the amount of the yarn 12 to be wrapped around the feed roll 16, the weaver merely changes the measuring drum 18, which comes in various sizes, with different diameters to vary the amount of the yarn 12 to be wrapped per revolution. The amount of yarn 12 that the weaver selects to be measured by the drum 18 is the length of yarn 12 that is needed to travel across a shed 50 of warp yarns 52. Drum 18 is rotated on a shaft 20A that is controlled by a first gear 22A. A larger gear 22B is the main gear driven by the loom itself through a shaft 20B. A smaller gear 22C is driven by the larger gear 22B through a timing belt 24. This smaller gear 22C, in turn, drives the single pick unit 10 through a shaft 20C.

After being wrapped around the feed roll 16, the measured amount of yarn 12 is blown down a tube 28 by a blower 30 operated by a motor 32. The tube 28 has a longitudinal slot 29 extending along its length a distance of about the same length as the measured amount of yarn 12. The yarn 12 extends out the far end of the tube 28. The return of the yarn 12 through a plurality of guides 34A, 34B, and 34C to a gripper 36 is controlled by a gripper arm 38. The gripper 36 holds the yarn 12 until a reed (not shown) swings through the shed 50 of warp yarns 52. A water jet nozzle 40 is positioned to shoot the measured amount of yarn 12, i.e. a single pick, across the shed 50 of the loom. When the nozzle 40 is ready to shoot the pick in a jet stream of water 42, the gripper arm 38 raises the gripper 36 so that the yarn 12 is released and the leading end of the measured amount of yarn 12 is shot across the shed 50 until it reaches the other side (not shown) of the loom. This shooting pays out the yarn 12 from the tube 28 through slot 29. When the measured amount of yarn 12 is paid out passed gripper 36, the gripper arm 38 lowers gripper 36 onto the trailing end of the measured amount of yarn 12 and holds the yarn 12 until a cutter (not shown) cuts the yarn 12 off between nozzle 40 and warp yarns 52. As the measured amount of yarn 12 is shot across the shed 50 by the nozzle 40, a second measured amount of yarn 12 is delivered from drum 16 to the tube 28 and a third measured amount of yarn 12 is measured by the drum 18. The interactions of these various elements are synchronized by a computer (not shown). As can be seen, in the single pick unit 10, three measured amounts of yarn 12 are being handled simultaneously.

FIG. 2 of the drawings depicts the "pick and pick" unit 100, so called because it handles two different "picks" or filling yarns 112 and 112', which may be either the same or diverse yarns, at the same time. This is a perspective view from an angle different than the angle of FIG. 1.

The yarns 112 and 112' are drawn from supply packages 114 and pass through fixed eyelets 116 and 116' into hollow tubes 118 and 118', respectively. After passing out of the tubes 118 and 118', the yarns 112 and 112' are diverted at an angle directly to first guides 120 and 120' which are secured to winding arms 122 and 122' that are, in turn, mounted on shafts 124 and 124', respectively. The shafts 124 and 124' rotate the winding arms 122 and 122' so that the yarns 112 and 112' are caused to be wrapped around stationary measuring drums 126 and 126'. The amounts of yarns 112 and 112' that are wrapped around the measuring drums 126 and 126', respectively, are predetermined by the winding arms 122 and 122' which typically make four turns around the drums 126 and 126'.

A lower gear 144 is driven by the loom through a shaft 146 while an upper gear 144' is driven by the lower gear 144 through a timing belt 147 so that the upper gear 144' may, in turn, drive the pick and pick unit 100. The elements inside the pick and pick unit 100 for connection to the measuring drums 126 and 126' are omitted for the sake of simplicity since such elements are conventional. The amounts of the yarns 112 and 112' which have been measured and wrapped around the drums 126 and 126' by the arms 122 and 122' then pass off the drums 126 and 126' and out through second guides 130 and 130'. From the guides 130 and 130', the yarns 112 and 112' are drawn under protective covers 132 and 132' through third guides 134 and 134' and adjustable fourth guides 136 and 136' to grippers 128 and 128'. The grippers 128 and 128' are controlled by gripper arms 138 and 138', respectively. The grippers 128 and 128' hold the yarns 112 and 112' until a reed (not shown) swings through the shed 150 of warp yarns 152. Water jet nozzles 140 and 140' are positioned to alternately project the measured amounts of yarns 112 and 112', i.e. a pick of yarn 112 and then a pick of yarn 112', across a shed 150 of the loom. This alternating operation is controlled by a switching valve (not shown) supplying water to the jet nozzles 140 and 140'.

When the nozzle 140 is ready to project the measured amount of yarn 112 in a jet stream of water 142, the gripper arm 138 raises the gripper 128 so that the measured amount of yarn 112 is released through a fifth guide 145 while the gripper arm 138' holds the gripper 128' down so that the measured amount of yarn 112' is retained. The leading end of the measured amount of yarn 112 is projected across the shed 150 until it reaches the other side (not shown) of the loom after paying off from drum 126. When the measured amount of yarn 112 is paid out, the gripper 128 comes down and closes on the trailing end of the measured amount of yarn 112 and holds it until a cutter (not shown) cuts the yarn 112 between nozzle 140 and warp yarns 152. After the measured amount of yarn 112 is cut off, the gripper arm 138' raises the gripper 128' so that the measured amount of yarn 112' is released through the fifth guide 145 and is projected by the nozzle 140' in a water jet stream 142' across the shed 150.

Two disadvantages of the prior art single pick unit 10 shown in FIG. 1 are that the motor 32, the blower 30, and the tube 28 take up space and require energy to operate, thus reducing the efficiency of the single pick unit 10.

Although the prior art pick and pick unit 100 shown in FIG. 2 does not require the motor 32, the blower 30, and the tube 28 for operational purposes, it is a major disadvantage that it takes about 18 man-hours to disconnect and replace the pick and pick unit 100 with the single pick unit 10 whenever a styling change must be made on the loom in order to produce a woven fabric by the single pick unit 10 because such woven fabric cannot be manufactured by the pick and pick unit 100.

SUMMARY OF THE INVENTION

It is a primary object of the present invention to provide a quick change kit for modifying a pick and pick unit of a fluid jet loom so that the amount of time required to make a styling change to produce fabric producible only by a single pick unit (and vice versa) is reduced from 18 to only three man-hours.

It is another object of the present invention to provide a modified pick and pick unit capable of functioning as a single pick unit to manufacture a style previously producible only by the single pick unit. Thus, the modified pick and pick unit functions as a single pick unit without the inefficiencies introduced by the motor, the blower, and the long tube for feeding the measured amount of yarn to the gripper and the fluid jet nozzle.

It is a further object of the present invention to provide a method of modifying a pick and pick unit so that it functions as a single pick unit with fewer elements and without the inefficiencies thereof.

With these and other objects, advantages, and features of the present invention that may become apparent hereinafter, the nature of the present invention should be more clearly understood by reference to the following detailed description of the invention, the appended claims, and the several views illustrated in the attached drawings.

DETAILED DESCRIPTION OF THE PREFERRED EMBODIMENT

Figure 1:
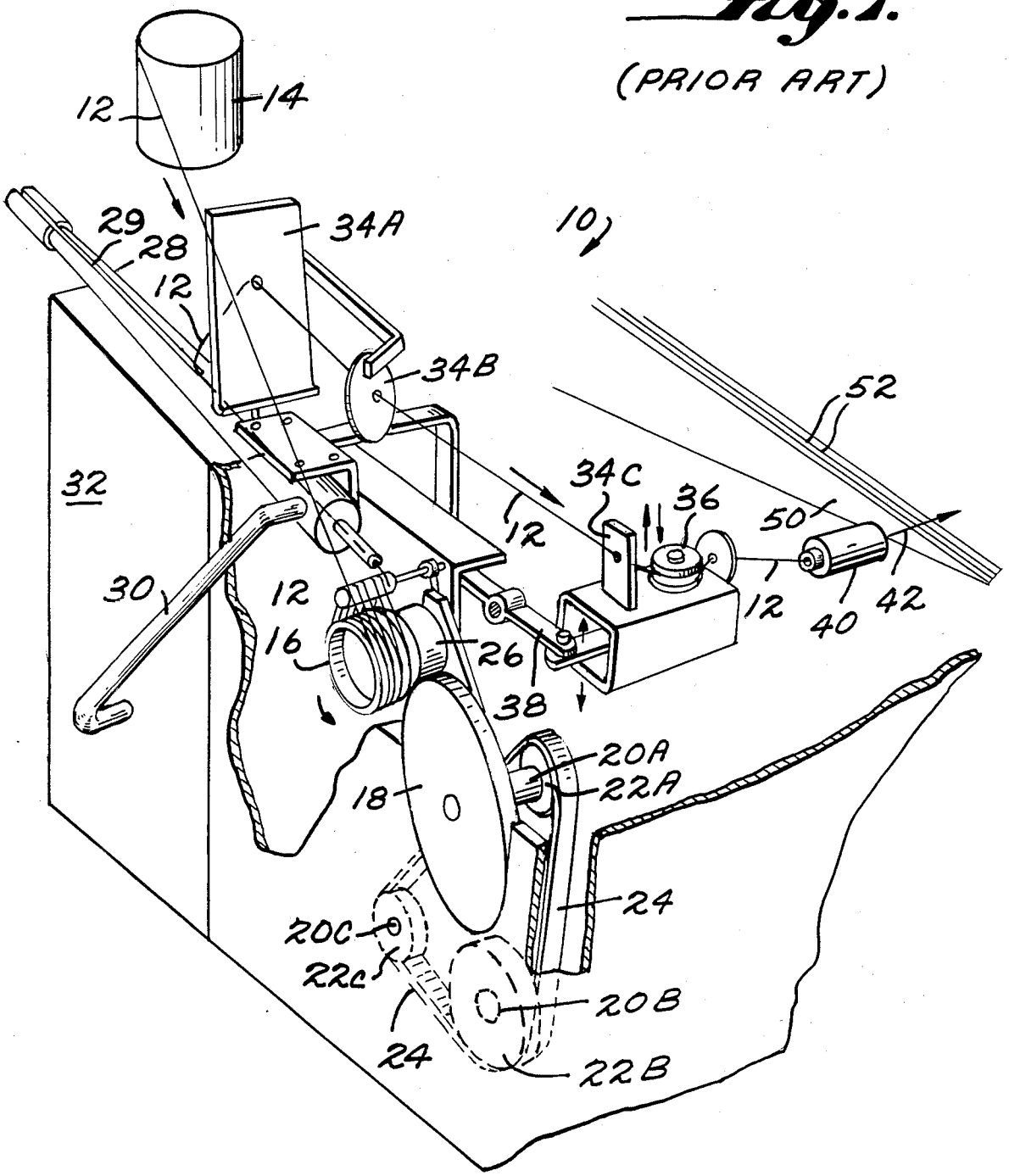
Fig. 1. (PRIOR ART)
FIG. 1 shows a perspective view of a single pick unit of the prior art type attached to a fluid jet weaving machine.
Figure 2:
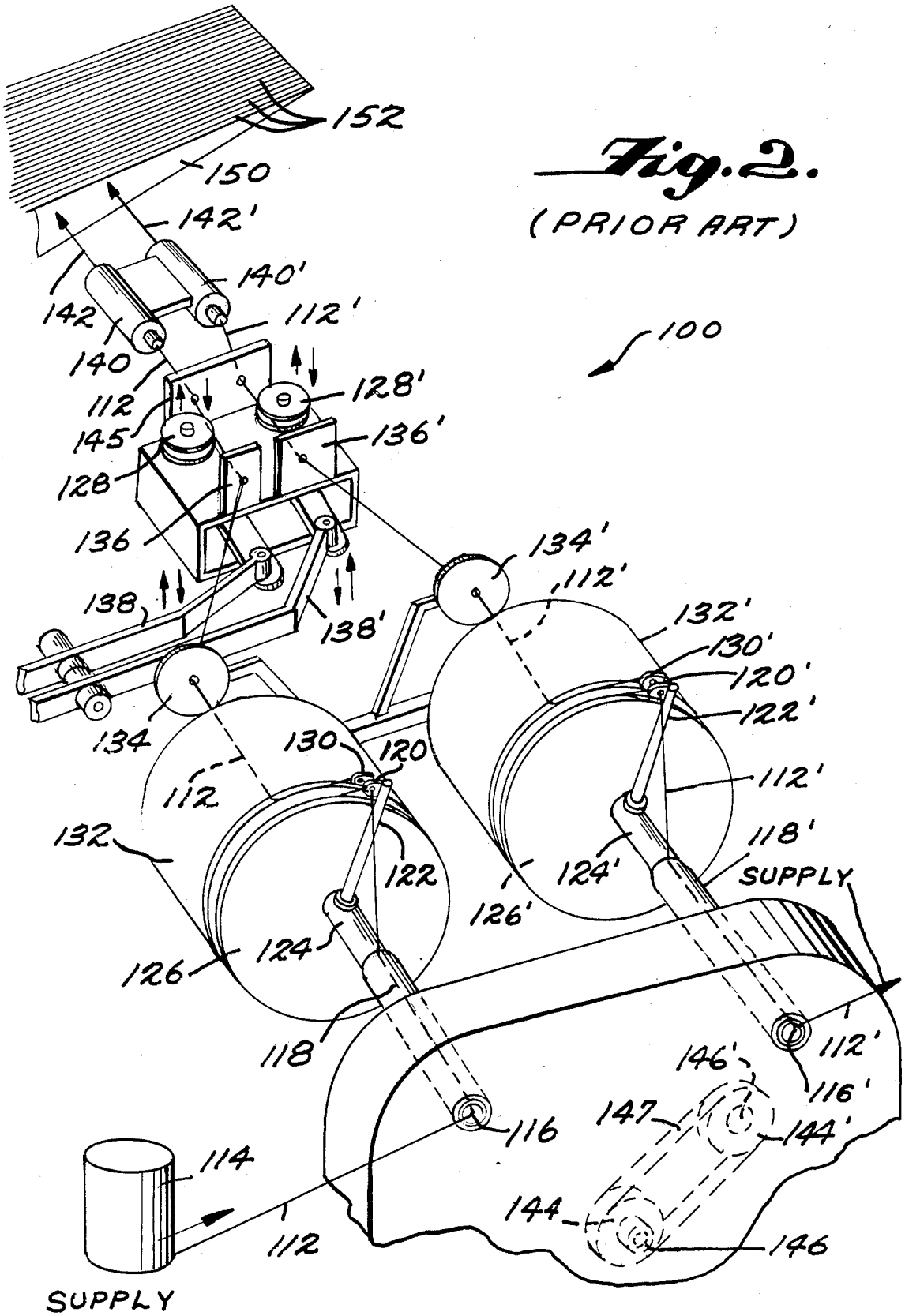
Fig. 2. (PRIOR ART)
FIG. 2 shows a perspective view of a so-called "pick and pick" unit of the prior art type attached to a fluid jet weaving machine.
Figure 3:
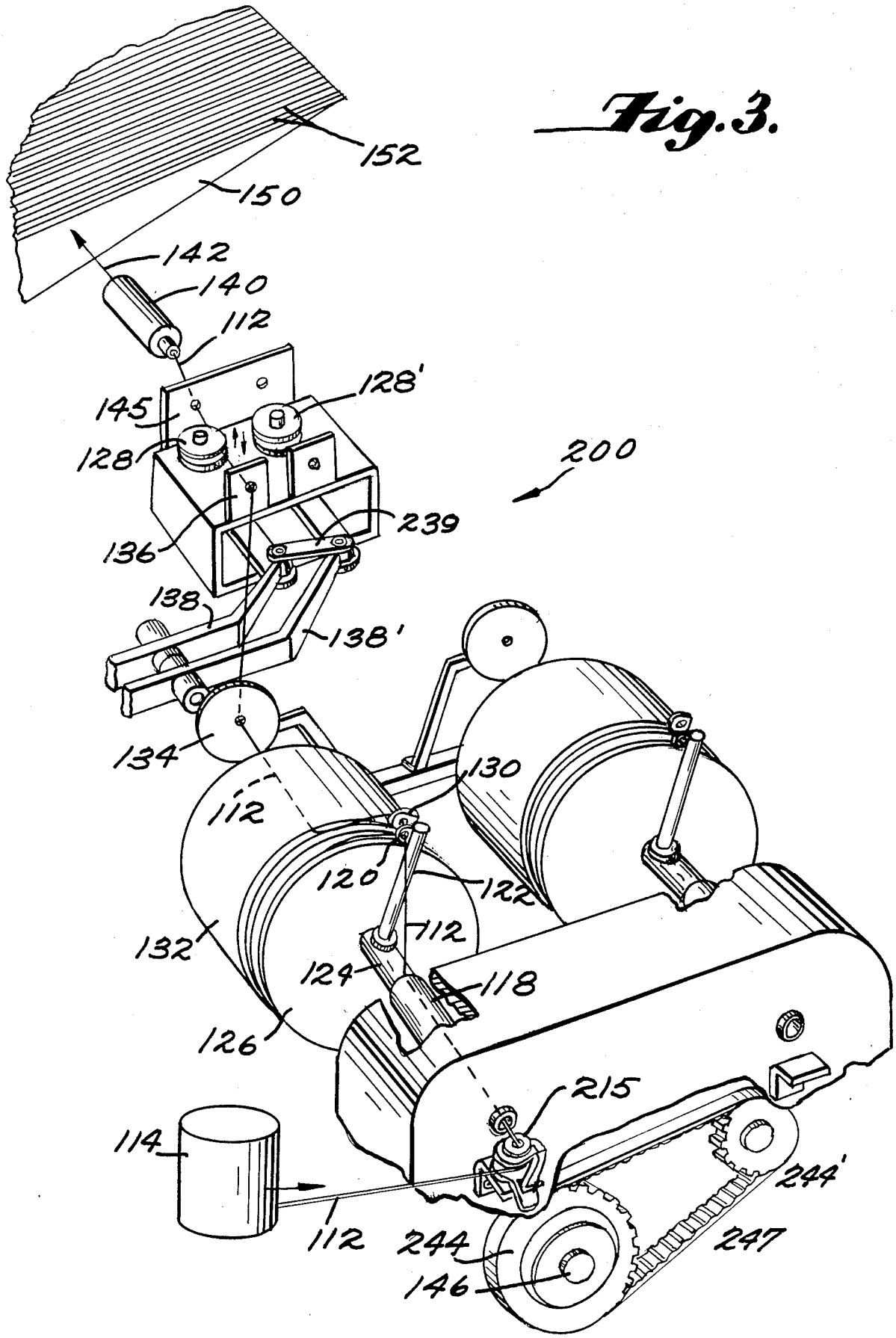
FIG. 3 shows a perspective view of a preferred embodiment of the present invention as a modified "pick and pick" unit that functions as a single pick unit without a motor, a blower, or tube for feeding a measured amount of yarn to a gripper and a fluid jet nozzle.

In FIG. 3 of the drawings, a modified "pick and pick" unit 200 of the present invention is illustrated. The "pick and pick" unit 100 of the prior art shown in FIG. 2 has been modified by disarming one picking unit and by doubling the speed of the other picking unit so that the modified "pick and pick" unit 200 of FIG. 3 functions as the single pick unit without the motor 32, the blower 30, and the long tube 28.

Such a modification has not been known to have been previously attempted; but rather it is believed that there have been many other failed attempts over the years to solve the problem of the time ineffiencies caused by the need to replace the single pick unit 10 with the "pick and pick" unit 100 and vice versa when a styling change is desired. With the present invention, instead of expending about 18 man-hours to make the conversion, only three man-hours are spent in modifying the "pick and pick" unit 100 of the prior art so that it performs the functions of the single pick unit 10 of the prior art. In fact, because the "pick and pick" unit 100 can be modified by the quick change kit of the present invention, the single pick unit 10 may now be considered obsolete for its current owners and unnecessary for potential buyers.

In the modified pick and pick unit 200 of the present invention shown in FIG. 3, the yarn 112 is drawn from the supply package 114 and passes around a roller guide 215 before entering the hollow tube 118. The roller guide 215 replaces the fixed eyelet 116 used in the prior art pick and pick unit 100 shown in FIG. 2. In developing the present invention, it was found that the fixed eyelet 116 of the prior art produced too much drag at the doubled speeds required for the modified pick and pick unit 200. When the supply package 114 became nearly depleted and small in diameter, the yarn ballooned excessively such that the fixed eyelet 116 exerted too much friction, causing the yarn 112 to break. However, the roller portion of the guide 215 allows the yarn 112 to roll more easily into the hollow tube 118 so that the friction is reduced and the yarn 112 does not break, even at double the speed of the prior art pick and pick unit 100 of FIG. 2. The preferred roller guide 215 is an off-the-shelf item which can be purchased from Eldon Specialties Inc., Burlington, N.C.

After passing out of the tube 118, the yarn 112 is diverted at an angle directly to the first guide 120 which is secured to the winding arm 122 that is, in turn, mounted on the shaft 124. The shaft 124 rotates the winding arm 122 so that the yarn 112 is caused to be wrapped around the stationary measuring drum 126. The amount of yarn 112 that is wrapped around the measuring drum 126 is predetermined by the winding arm 122 which rotates twice as fast around the drum 126 in the modified pick and pick unit 200 of FIG. 3 as in the prior art pick and pick unit 100 of FIG. 2. This doubling of the speed of the modified pick and pick unit 200 was not and could not be obtained merely by turning up a dial. In order to achieve a change in speed, the two identical gears 144 and 144' and the timing belt 147 shown in the prior art pick and pick unit 100 of FIG. 2 were replaced with a first large gear 244 having a given number of teeth and a second small gear 244', having half as many teeth as the first large gear 244, and a timing belt 247. The gears 244 and 244' were custom-designed to solve the speed ratio problem of two to one with teeth numbering preferably 42 and 21, respectively. The preferred choice for the timing belt 247 is a 60-tooth belt manufactured by Dixie Bearing Co., Kingsport, Tenn. The large gear 244 is the main driving gear and is driven by the shaft 146 of the loom. The large gear 244 drives the timing belt 247, which drives the small gear 244', which, in turn, drives the modified pick and pick unit 200. The gearing inside the modified pick and pick unit 200 is unchanged from that of the prior art pick and pick unit 100. Thus, the shaft 124 rotates the winding arm 122 an appropriate number of times so that a chosen amount of yarn 112 is measured and wrapped around the stationary drum 126. Thereafter, the yarn 112 is released by the gripper 128, drawn by the jet 140 off the drum 126, through the second guide 130, under the protective cover 132, through the third guide 134, the fourth guide 136, and the fifth guide 145.

In the modified pick and pick unit 200 of FIG. 3, it is necessary to make the one gripper 128 perform the gripping functions that the two grippers 128 and 128' did on the prior art pick and pick unit 100 of FIG. 2. In order to make the gripper 128 of the modified pick and pick unit 200 of FIG. 3 work twice as fast as it did previously on the prior art pick and pick unit 100 of FIG. 2, a timing bracket 239 is fixed securely across both gripper arms 138 and 138' so that these gripper arms 138 and 138' are tied together. Thus, the one gripper arm 138 is actuated on its own cycle and that of gripper arm 138', to open and close gripper 128. In other words, the gripper 128 goes up and down two times in the same time interval during which it went up and down only once in the prior art pick and pick unit 100 of FIG. 2.

In order to make every water jet be directed to the one nozzle 140 and not to the other nozzle 140', the switching valve (not shown) is simply disconnected.

The single gripper 128 holds the leading end of a measured amount of yarn 112 until a reed (not shown) swings through the warp yarns 152. When the nozzle 140 is ready to project the measured amount of yarn 112 in the single jet stream of water 142, the gripper arm 138 raises the gripper 128 after one time interval as in the pick and pick unit 100 of FIG. 2. Then, the water jet nozzle 140 projects the measured amount of yarn 112, i.e. the pick, across the shed 150 of the loom.

In order to prevent accidental firing of the second water jet nozzle 140' which is used in the prior art pick and pick unit 100 of FIG. 2, such second nozzle 140' is removed from the modified pick and pick unit 200 of FIG. 3. Note that, although the winding arm 122' and the gripper arm 128' as well as other elements do not handle a second measured amount of yarn 112', these elements are preferably left intact and not removed from the modified pick and pick unit 200 in order to minimize the labor required to change back and forth between single pick and "pick and pick" operations.

The modified pick and pick unit 200 of the present invention is not only capable of being quickly changed to function as a single pick unit, but it does so at increased efficiency because the unit 200 operates without the motor 32, the blower 30, and the tube 28 of the prior art single pick unit 10. This increased efficiency was an unexpected result of the present invention since it was initially thought that modifying the prior art pick and pick unit 100 would either result in reduced efficiency or at least the same efficiency rate of weaving an energy utilization as existed in the prior art.

The foregoing preferred embodiment is considered illustrative only. Other modifications and changes may occur to those persons skilled in the textile art. Thus, the disclosed invention is not limited to the exact construction and operation shown and described hereinabove.

In particular, although the invention is shown with reference to Nissan water jet weaving machines, it is not limited thereto.

We claim:

1. A quick change kit for modifying a pick and pick unit of a fluid jet for weaving machines, said pick and pick unit having a pair of yarn inlets, a pair of drum means for holding measured amounts of yarn, a pair of means for winding the measured amounts of yarn on the drum means, a pair of means for gripping the yarn, means for actuating each gripping means at a given rate, and fluid jet nozzle means for alternately projecting the measured amounts of yarn across the loom, wherein the kit comprises:

a first gear means adapted to be driven by the loom;

a second gear means, adapted to be driven by the first gear means, for driving the pick and pick unit;

said first and second gear means having a respective two-to-one tooth ratio;

a guide means, adapted to be mounted at one of the yarn inlets, for permitting entry of the yarn into the one yarn inlet with reduced friction; and means for joining each of the actuating means to cause them to move together so that one of the gripping means is actuated by each of the actuating means;

whereby the pick and pick unit can be quickly changed to function as a single pick unit.

2. A quick change kit as claimed in claim 1 wherein the first and second gear means have 42 and 21 teeth, respectively.

3. A quick change kit as claimed in claim 1 wherein the second gear means includes a belt and a gear.

4. A quick change kit as claimed in claim 1 wherein the guide means is a roller guide.

5. A quick change kit as claimed in claim 1 wherein the joining means is a bracket means for securing the actuating means together.

6. A modified pick and pick unit of a fluid jet weaving machine, comprising:

a yarn inlet;

a guide means, mounted at the yarn inlet, for introducing the yarn into the yarn inlet with reduced friction;

drum means for holding a measured amount of yarn;

means for winding the measured amount of yarn on the drum means;

means for gripping the yarn;

a pair of means for actuating the gripping means, each actuating at a given rate, but out of phase with one another;

means for joining the pair of actuating means so that they actuate the gripping means at twice the given rate;

a first gear means driven by the loom;

a second gear means, driven by the first gear means, for driving the modified pick and pick unit;

said first gear means and said second gear means having a respective two-to-one tooth ratio; and fluid jet nozzle means for projecting each measured amount of yarn across the loom;

whereby the modified pick and pick unit functions as a single pick unit.

7. A unit a claimed in claim 6 wherein the first and second gear means have 42 and 21 teeth, respectively.

8. A unit as claimed in claim 6 wherein the second gear means includes a belt and a gear.

9. A unit as claimed in claim 6 wherein the guide means is a roller guide.

10. A unit as claimed in claim 6 wherein the joining means is a bracket means for securing the actuating means together.

11. A unit as claimed in claim 6 having two of said drum means, winding means, and gripping means, one each of which is idle during single pick operations but is used for pick-and-pick operations.

12. A loom having a modified pick-and-pick unit for pick insertion as claimed in claim 6.

13. A method of modifying a pick and pick unit of a fluid jet weaving machine for single pick operation, said pick and pick unit having a pair of yarn inlets, a pair of drum means for holding measured amounts of yarn, means for winding the measured amounts of yarn on the respective drum means, a pair of means for gripping the measured amounts of yarn, a pair of means for actuating a respective one of the pair of gripping means at a given rate, a pair of fluid jet nozzle means for alternately projecting measured amounts of yarn across the loom as determined by a switching valve, a first gear driven by the loom, a second gear means for driving the pick and pick unit, and a timing belt means for transferring mechanical energy from the first gear to the second gear means, wherein the method comprises the steps of:

mounting a guide means at one of the yarn inlets for allowing the yarn to roll into the one yarn inlet with reduced friction;

securing the actuating means together in order to cause the pair of actuating means to move together so that one of the gripping means is actuated at twice the given rate;

replacing the first gear with a first replacement gear having a given number of teeth;

replacing the second gear means with a second replacement gear having half as many teeth as the first replacement gear;

replacing the timing belt means with a belt means adapted for use with the replacement gears for transferring mechanical energy from the first replacement gear to the second replacement gear; and disconnecting the switching valve so that all yarn projections emanate from one fluid jet nozzle means;

whereby the pick and pick unit is modified to function as a single pick unit.

14. A method of returning a modified pick and pick unit of a fluid jet weaving machine from single pick operation to pick-and-pick operation, said pick and pick unit having a pair of yarn inlets, a pair of drum means for holding measured amounts of yarn, means for winding the measured amounts of yarn on the respective drum means, a pair of means for gripping the measured amounts of yarn, a pair of means for actuating respective ones of the gripping means at a given rate, said actuating means being joined together to cause actuation of a gripping means at twice the given rate, a pair of fluid jet nozzle means, one of which is idle and the other of which projects measured amounts of yarn across the loom, a first gear driven by the loom, a second gear means for driving the modified pick and pick unit, and a timing belt means for transferring mechanical energy from the first gear to the second gear means, wherein the method comprises the steps of:

severing the actuating means from one another in order to cause each of the pair of actuating means to move independently so that each of the gripping means is actuated by its respective actuating means at the given rate;

replacing the first gear with a first replacement gear having a given number of teeth;

replacing the second gear means with a second replacement gear having the same number of teeth as the first replacement gear;

replacing the timing belt means with a timing belt means adapted for use with the first and second replacement gears; and providing for alternate projections of measured amounts of yarn from the idle fluid jet nozzle and the other fluid jet nozzle;

whereby the modified pick and pick unit is returned to pick-and-pick operation.

* * * * *